US005857614A

United States Patent [19]

Walsh

[11] Patent Number: 5,857,614

[45] Date of Patent: Jan. 12, 1999

[54] CARTON BLANK AND CARTON FORMED THEREFROM

[75] Inventor: Joseph C. Walsh, Longmont, Colo.

[73] Assignee: Graphic Packaging Corporation, Boulder, Colo.

[21] Appl. No.: 934,269

[22] Filed: Sep. 19, 1997

[51] Int. Cl.[6] ..... B65D 17/00

[52] U.S. Cl. ..... 229/231; 229/117.31; 229/160.2; 229/125.04

[58] Field of Search ..... 229/231, 160.2, 229/207, 125.04, 208, 209, 230, 3.1, 924, 925, 243, 242, 241, 4.5; 220/461, 463

[56] References Cited

U.S. PATENT DOCUMENTS

| | | | |
|---|---|---|---|
| 3,116,869 | 1/1964 | Kauffeld | 229/243 |
| 3,347,446 | 10/1967 | Guyer et al. | 229/207 X |
| 3,389,852 | 6/1968 | Egli | 229/243 |
| 3,426,955 | 2/1969 | Olson | 229/117.3 X |
| 3,580,466 | 5/1971 | Thelen | 229/117.31 |
| 3,580,483 | 5/1971 | Young | 229/208 |
| 3,764,058 | 10/1973 | Forbes, Jr. | 229/231 |
| 3,905,646 | 9/1975 | Brackmann et al. | 229/207 X |
| 3,942,708 | 3/1976 | Christensson | 220/462 X |
| 3,981,433 | 9/1976 | Thornhill | 229/4.5 X |
| 4,702,407 | 10/1987 | Lisiecki | 229/925 X |
| 5,031,825 | 7/1991 | Romagnoli | 229/231 X |
| 5,078,273 | 1/1992 | Kuchenbecker | 229/924 X |
| 5,222,660 | 6/1993 | Koss | 229/231 |
| 5,415,910 | 5/1995 | Knauf | 229/3.1 X |
| 5,494,215 | 2/1996 | Drummond et al. | 229/4.5 X |
| 5,624,033 | 4/1997 | Arai et al. | 229/241 X |
| 5,632,402 | 5/1997 | Walsh et al. | 229/3.1 X |

FOREIGN PATENT DOCUMENTS 276581 9/1927 United Kingdom .

*Primary Examiner*—Gary E. Elkins
*Assistant Examiner*—Tri M. Mai
*Attorney, Agent, or Firm*—Klaas, Law, O'Meara & Malkin, P.C.; Joseph J. Kelly

[57] ABSTRACT

A carton formed from a carton blank so that the carton has an outer layer formed from a relatively rigid material and an inner layer formed from a relatively flexible fluid impervious material. The outer layer and the inner layer have superposed weakened portions secured together so that the carton may be opened along the superposed weakened portions in one simultaneous operation. Also, in another embodiment, a similar carton is provided with a pour spout.

19 Claims, 2 Drawing Sheets

CARTON BLANK AND CARTON FORMED THEREFROM

FIELD OF THE INVENTION

This invention is directed generally to a carton blank and carton formed therefrom and more particularly to a leakproof carton from which the materials contained therein may be readily removed.

BACKGROUND OF THE INVENTION

There are many kinds of leakproof cartons on the market. The vast majority of these cartons have an outer layer formed from a relatively rigid material for protection and an inner layer formed from a relatively flexible material for providing the leakproof qualities. When it is desired to remove the material in the carton, it is necessary to first open the outer layer, and then open the inner layer. Also, the inner layer generally is not secured to the outer layer so access to the inner layer sometimes presents a problem. This is particularly true in leakproof cartons that are designed to hold only one serving. Another problem relates to the formation of a pour spout in such cartons.

BRIEF DESCRIPTION OF THE INVENTION

This invention provides a leakproof carton comprising an outer layer formed from a relatively rigid material and an inner layer formed from a relatively flexible fluid impervious material which carton is readily opened in one simultaneous operation so that the material therein may be readily removed. Also, the parts of the outer and inner layer adjacent to the opening remain secured together to facilitate further the removal of the material contained therein. The invention also provides a carton blank from which the carton is formed.

In a preferred embodiment of the invention, the carton blank comprises a unitary sheet of a relatively rigid material having an inner surface and an outer surface, a left side edge, a right side edge, a top edge and a bottom edge. The unitary sheet of a relatively rigid material has a length extending from the top edge to the bottom edge and a width extending from the left side edge to the right side edge. The unitary sheet of relatively rigid material has a plurality of cut and fold lines for dividing the unitary sheet of a relatively rigid material in a conventional manner into a plurality of panels including into a back wall panel, a front wall panel, opposite sidewall panels, a glue tab panel and top and bottom panels extending outwardly in opposite directions from the front wall, back wall and opposite sidewall panels. The glue tab panel has a top edge and a bottom edge. The carton blank also comprises a generally rectangular sheet of a relatively flexible fluid impervious material having an inner surface and an outer surface, a central body portion, a top body portion, a bottom body portion, a left side edge, a right side edge and top and bottom edges. The central body portion of the rectangular sheet of a relatively flexible fluid impervious material is secured to opposite portions of the unitary sheet of a relatively rigid material. Linearly extending weakened portions are formed in at least portions of the unitary sheet of a relatively rigid material that is secured to the central body portion. At least portions of the generally rectangular sheet of a relatively flexible fluid impervious material are easily separated along a line opposite to the linearly extending opening means. The at least portions are joined together by adhesive to preserve the integrity of the generally rectangular sheet of a relatively flexible fluid impervious material but to permit the separation thereof.

In a preferred embodiment of the invention, the relatively flexible fluid impervious material comprises a plastic material. The generally rectangular sheet of a plastic material comprises a separate first portion and a separate second portion with at least portions of one of the separate first and second portions overlying at least portions of the other of the first and second portions. A continuous portion of the first portion is secured to a continuous portion of the second portion to preserve the integrity of the generally rectangular sheet of a plastic material. At least a portion of the continuous portions is located opposite to the linearly extending weakened portions to permit the separation of the first and second portions simultaneously with the outer layer.

In another preferred embodiment of the invention, the rectangular sheet of a relatively flexible fluid impervious material comprises a laminate of a paper material and a plastic material with the paper material being secured to opposite portions of the unitary sheet of a relatively rigid material. The generally rectangular sheet of a relatively flexible fluid impervious material comprises a separate first portion and a separate second portion. Each of the separate first and second portions has an edge portion with the edge portions being in a face to face relationship and located opposite to the linearly extending opening means. At least all of the edge portions of the paper portions are secured together to preserve the integrity of the generally rectangular sheet of a relatively flexible fluid impervious material but to permit separation of the first and second portions simultaneously with the outer layer.

In another preferred embodiment of the invention, the generally rectangular sheet of a relatively flexible fluid impervious material comprises a laminate of a generally rectangular sheet of a relatively flexible paper material and a plastic material wherein the plastic material comprises a separate first portion and a separate second portion. At least portions of one of the separate first and second portions overlies at least portions of the other of the separate first and second portions. A continuous portion of the first portion is secured to a continuous portion of the second portion to preserve the integrity of the generally rectangular sheet of a relatively flexible fluid impervious material. At least a portion of the continuous portions is located opposite to the linearly extending weakened portions to permit the separation of the first and second portions simultaneously with the outer layer.

In another preferred embodiment of the invention, the conventional panel portions have a front wall panel, a back wall panel and at least one sidewall panel portion having opposite side edges. The front and back wall panels are integral with one of the opposite side edges and are joined to the at least one sidewall panel portion by a fold line. The linearly extending weakened portions of the outer layer extend from a location in one of the front and back wall panels to a location in the other of the front and back wall panels.

In another preferred embodiment of the invention, the carton formed from the carton blank is provided with a pour spout. One of the sidewall panels has opposite substantially parallel side edges formed by a portion of the fold lines. Linearly extending weakened portions, similar to those described above, have at least one portion extending between the opposite side edges and terminate in opposite ends. The opposite side edges are formed as linearly extending weakened portions extending from the opposite ends. Spout forming material is provided and has a central portion and two wing portions integral with the central portion and extending outwardly on either side thereof. At least a portion of the central portion is secured to at least a portion of the central body portion of the generally rectangular sheet secured to opposite portions of the opposite side edges.

A carton formed from the above described carton blanks comprises an outer layer formed from the relatively rigid material and having linearly extending weakened portions formed in at least parts thereof and an inner layer formed from the relatively flexible fluid impervious material and having a central body portion secured to opposite portions of the outer layer. The central body portion has a weakened portion along a line opposite to the linearly extending weakened portions so that one opening can be simultaneously formed in the outer and inner layers.

In all of the above cartons, the outer and inner layers are in a sealed together relationship in the areas adjacent to the opening.

BRIEF DESCRIPTION OF THE DRAWINGS

Various embodiment of the invention are illustrated in the drawing in which.

DETAILED DESCRIPTION OF THE INVENTION

Figure 1:
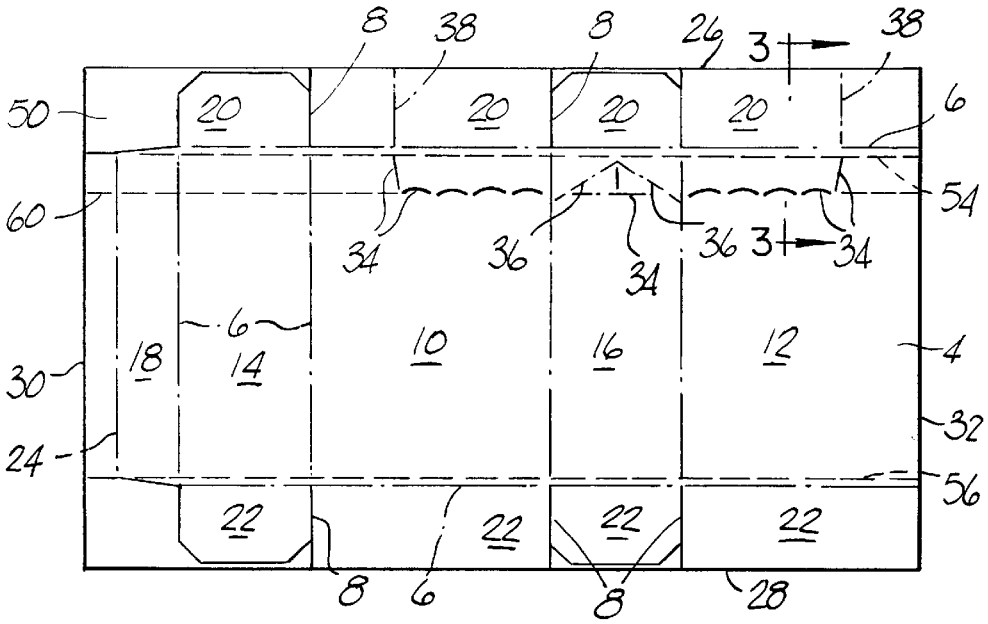
FIG. 1 is a top plan view of a carton blank of this invention.

In FIG. 1, there is illustrated a carton blank 2 having an outer layer comprising a unitary sheet 4 of a relatively rigid material, such as a composite material described in U.S. Pat. No. 4,254,173 to Peer, Jr., which is incorporated herein by reference thereto, a conventional paperboard or other materials having similar characteristics. The unitary sheet 4 is provided with a plurality of fold lines 6 and cut lines 8 to form a front panel 10, a back panel 12, opposite sidewall panels 14 and 16, a glue tab panel 18, top panels 20 and bottom panels 22. The glue tab panel 18 also has a fold line 24. The unitary sheet 4 has a top edge 26, a bottom edge 28, a left side edge 30 and a right side edge 32. It is understood that the unitary sheet may have other configurations.

The unitary sheet 4 is provided with linearly extending weakened portion which as illustrated in FIG. 1 comprises conventional perforated lines 34 in the front panel 10, the back panel 12 and the sidewall panel 16 which also has fold lines 36. Also, perforated lines 38 are formed in two of the top panels 20. All of these perforated lines 34, fold lines 36 and perforated lines 38 function to provide an opening as described below. However, it is understood that other types of conventional opening means may be employed within the concepts of this invention.

The carton blank 2 also has an inner layer comprising a generally rectangular sheet 50, preferably of a fluid impervious material, having a central body portion 52 located between the lines 54 and 56 that is secured to opposite portions of the unitary sheet 4 by a suitable adhesive 58. The generally rectangular sheet 50 has a weakened portion 60, by various means some of which are described below, at least part of which is located opposite to portions of the linearly extending perforated lines 34 for purposes described below. The weakened portion 60 is illustrated in FIG. 1 by a dashed line.

Figure 3:
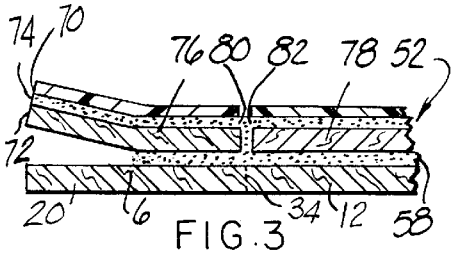
FIG. 3 is a cross-sectional view taken on the line 3—3 of FIG. 1 of one embodiment of the carton blank of this invention.

One preferred embodiment of the invention is illustrated in FIG. 3. The generally rectangular sheet 50 comprises a plastic material 70 laminated to a relatively flexible paper material 72 by a suitable adhesive 74. The generally rectangular sheet 50 has a first portion 76 and a second portion 78 having edges 80 and 82 in a face to face relationship which are located to form the weakened portion 60. The plastic material 70 can be a polypropylene material or any other type of material having similar characteristics. The paper material 72 can be formed from Kraft or recycled fibers or any other materials having similar characteristics. The central body portion 52 of the paper material 64 is secured to opposite portions of the unitary sheet 4, illustrated in FIG. 3 as the back panel 12, by a suitable adhesive 58 wherein a portion of the adhesive 58 is located between the side edges 80 and 82 to preserve the integrity of the generally rectangular sheet 50 of a relatively flexible fluid impervious material and to permit separation of the first and second portions 76 and 78 as described below.

Figure 4:
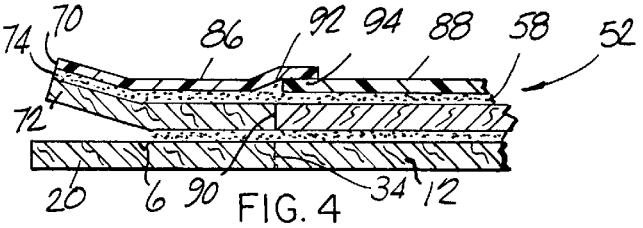
FIG. 4 is a cross-sectional view similar to FIG. 3 of another embodiment of the carton blank of this invention.

Another preferred embodiment of the invention is illustrated in FIG. 4. The generally rectangular sheet 50 comprises a plastic material 70 comprising a first portion 86 and a second portion 88 laminated to the paper material 72, comprising a unitary sheet, by the adhesive 74. The paper material 72 is provided with a series of perforations 90 to provide the weakened portion 60. The adhesive 74 joins the first and second portions 86 and 88 along a continuous line 92 to preserve the integrity of the generally rectangular sheet 50 of a relatively flexible fluid impervious material. The adhesive 74 preferably comprises a hot melt adhesive so, if the outer surface of the plastic material 70 is provided with a heat sealing adhesive, the overlying portions 94 will be sealed together to further ensure the integrity of the generally rectangular sheet 50. However the perforations 90 and the adhesive 74 and the overlying portions 94 permit separation of the generally rectangular sheet 50 along the lines 90 and 92 for purposes described below.

Figure 5:
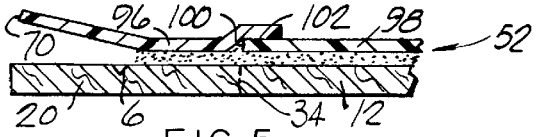
FIG. 5 is a cross-sectional view similar to FIG. 3 of another embodiment of the carton blank of this invention.

Another preferred embodiment of the invention is illustrated in FIG. 5. The generally rectangular sheet 50 comprises the plastic material 70 comprising a first portion 96 and a second portion 98. The central body portion 52 of the first and second portions 96 and 98 is secured to the unitary sheet 4 by the adhesive 58 which joins the first and second portions 96 and 98 along the continuous line 100 to preserve the integrity of the generally rectangular sheet 50 of a relatively flexible fluid impervious material. Also, the adhesive 58 preferably comprises a hot melt adhesive so, if the outer surface of the plastic material 70 is provided with a heat sealing adhesive, the overlying portions 102 will be sealed together to further ensure the integrity of the generally rectangular sheet 50. However, the continuous line 100 and the overlying portions 102 permit separation of the generally rectangular sheet 50 for purposes described below.

Figure 2:
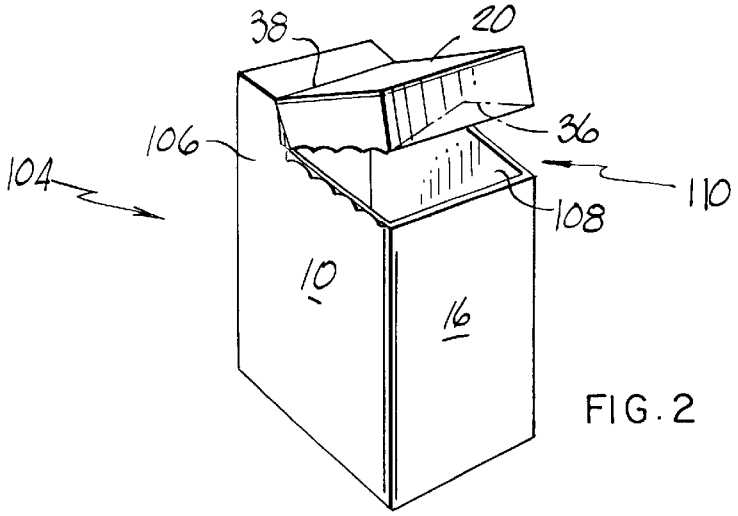
FIG. 2 is a perspective view of a carton formed from the carton blank of FIG. 1 in an opened position.

In FIG. 2, there is illustrated an opened carton 104 having an outer layer 106 and an inner layer 108 formed from any of the embodiments of the invention such as those illustrated in FIGS. 3–5. The carton blank 2 is folded around the fold lines 6 and 18 to form an open ended enclosure (not shown). The bottom panels 22 and the corresponding bottom portion of the generally rectangular sheet 50 are folded and sealed together to form a carton having one open end (not shown) which is then filled with the desired material and the top panels 20 and the corresponding top portion of the generally rectangular sheet 50 are folded together and sealed to form the filled carton (not shown). When it is desired to remove the material from the carton, pressure is applied to the portion of the sidewall 16 enclosed by the fold lines 36 and the perforated line 34 and the outer and inner layers 106 and 108 are opened simultaneously along the linearly extending opening means 34 and the weakened portion 60 and folded back along the fold lines 38 to provide an opening 110. The portions of the outer and inner layers 106 and 108 adjacent to the opening 110 are sealed together by the adhesives 58 and 74.

Figure 6:
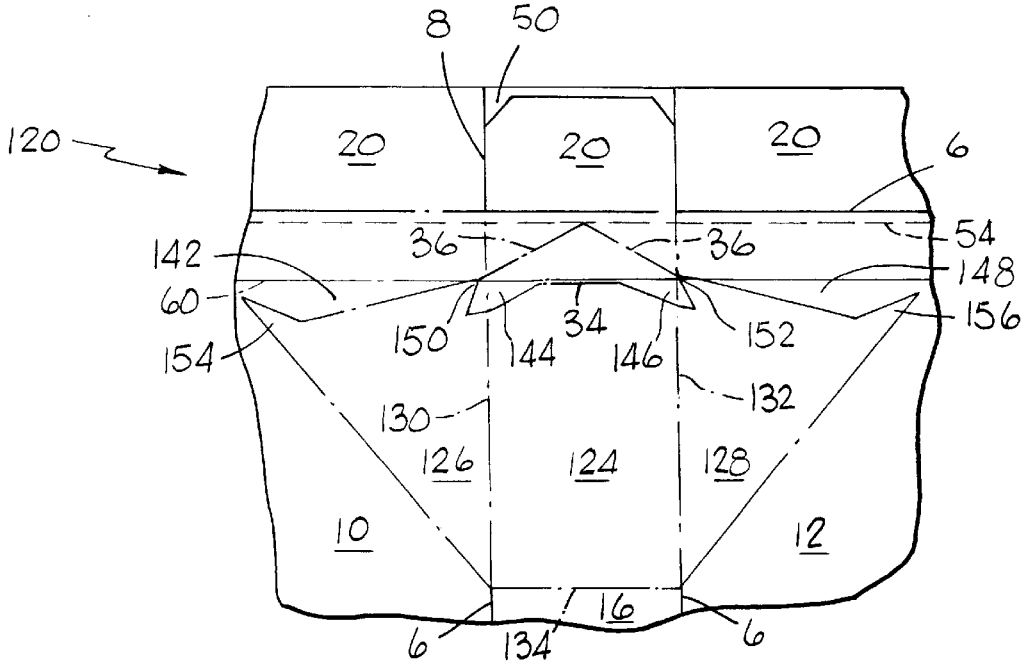
FIG. 6 is a partial top plan view of another embodiment of a carton blank of the invention.
Figure 7:
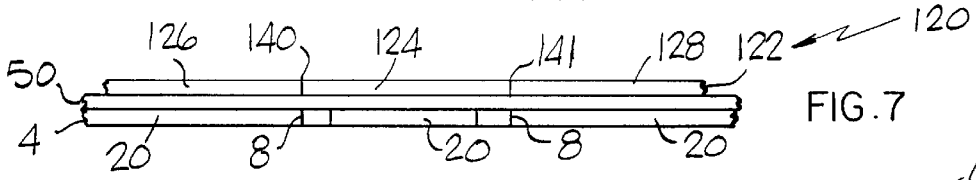
FIG. 7 is a top plan end of FIG. 6.
Figure 8:
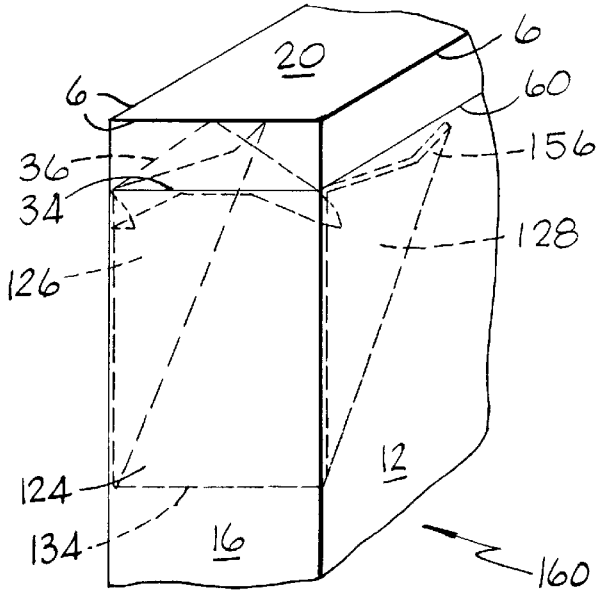
FIG. 8 is a perspective view of a portion of a carton formed from the carton blank of FIG. 6.

In FIGS. 6–8, there is illustrated another preferred embodiment of the invention for forming a pour spout in a carton. The portions of the invention in FIGS. 6–8 that correspond to portions of the invention in FIGS. 1–5 have been identified with the same reference numerals.

In FIGS. 6 and 7, there is illustrated a portion of another preferred carton blank 120 that comprises a unitary sheet 4 of a relatively rigid material and a generally rectangular sheet 50 of a relatively flexible fluid impervious material, as described above.

A spout forming piece 122 of a relatively rigid material is provided and has a central portion 124 and two wing portions 126 and 128. The spout forming piece 122 is formed from a material such as that described in the Peer, Jr. patent, a conventional paperboard or a relatively rigid plastic material, such as polypropylene or polyester. Perforated lines 130 and 132 form opposite side edges for the sidewall panel 16 in a portion of the fold lines 6 of the unitary sheet 4 of a relatively rigid material and another fold line 134 is also formed therein. The central portion 124 is secured to that portion of the generally rectangular sheet 50 of a relatively flexible fluid impervious material secured to the portion of sidewall panel 16 between the perforated lines 130 and 132, the weakened portion 34 and the fold line 134.

A fold line 140 connects wing portion 126 to the central portion 124 and a fold line 141 connects wing portion 128 to the central portion 124. Cut out portions 142, 144, 146 and 148 in the central portion 124 and the wing portions 126 and 128 function to provide sharp, pointed projections 150 and 152 for purposes described below. Stop portions 154 and 156 limit the outward movement of the wing portions 126 and 128. The wing portions 126 and 128 are not secured to any other portion of the carton blank 120.

Figure 9:
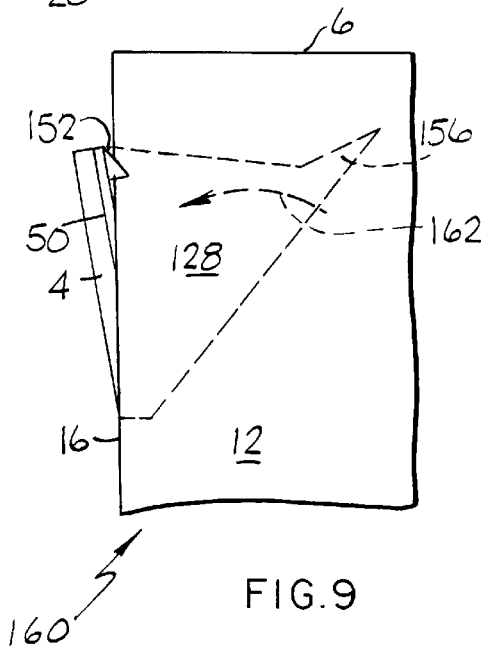
FIG. 9 is a partial side elevational view of a portion of FIG. 8 showing the spout partially opened.

The operation of a carton 160 formed from the carton blank 120 is illustrated in FIGS. 8 and 9. In FIG. 8, the carton blank has been folded to form the carton 160 which has been filled with a desired product and sealed. The wing portions 126 and 128 are adjacent to portions of the front 10 and back 12 panels. When it is desired to remove portions of the product from the carton 160, a finger (not shown) is placed against the portion of the unitary sheet 4 of a relatively rigid material defined by the lines 34 and 36 and sufficient force is applied to move these portions inwardly. This operation breaks the weakened portions 34 and part of 60. The finger is then moved against a portion of the central portion 124 and an outwardly directed force is applied thereto to move the sharp pointed projections 150 and 152 into contact with and to pierce portions of the generally rectangular sheet 50 of a relatively flexible fluid impervious material. The continued outward movement of the central portion 124, as indicated by the arrow 162, also moves the portion of the unitary sheet 4 of a relatively rigid material outwardly breaking the perforations 130 and 132 and pivoting around the fold line 134. The generally rectangular sheet 50 of a relatively flexible fluid impervious material also splits along a line corresponding to the perforations 130 and 132. The wing portions 126 and 128 also move outwardly to provide the side portions of the pour spout in cooperation with the central portion 124.

It is contemplated that the inventive concepts herein described may be variously otherwise embodied and it is intended that the appended claims be construed to include alternative embodiments of the invention except insofar as limited by the prior art.

What is claimed is:

1. A carton blank comprising:

a unitary sheet of a relatively rigid material;

said unitary sheet of a relatively rigid material having a plurality of cut and fold lines for dividing said unitary sheet of a relatively rigid material into conventional panel portions having at least a central body portion having at least three panel portions joined by two fold lines;

a generally rectangular sheet of a relatively flexible fluid impervious material having at least a central body portion;

at least portions of said at least a central body portion of said rectangular sheet being secured to said at least a central body portion of said unitary sheet;

continuous linearly extending weakened portions formed in said at least three panel portions of said unitary sheet;

at least a portion of said generally rectangular sheet being weakened along a line opposite to said continuous linearly extending weakened portions;

a continuous coating of adhesive securing together the portions of said at least a central body portion of said unitary sheet and said at least a central body portion of said generally rectangular sheet along and adjacent to said weakened portions; and said continuous coating of adhesive cooperating with said at least a portion of said generally rectangular sheet to preserve the integrity of said generally rectangular sheet but to permit the simultaneously separation thereof with said unitary sheet.

2. A carton blank as in claim 1 wherein:

said generally rectangular sheet comprises a plastic material.

3. A carton blank as in claim 2 wherein:

said generally rectangular sheet of a plastic material comprises a separate first portion and a separate second portion having adjacent edge portions;

at least portions of one of said first and second portions being in an overlying relationship with at least portions of the other of said first and second portions;

a continuous portion of said overlying portions being secured together to preserve the integrity of said generally rectangular sheet of a relatively flexible fluid impervious material; and at least a portion of said continuous portion being located opposite to said linearly extending weakened portions to permit the separation of said first and second portions simultaneously with said unitary sheet.

4. A carton blank as in claim 1 wherein:

said rectangular sheet comprises a laminate of a paper material and a plastic material with said paper material being secured to opposite portions of said unitary sheet.

5. A carton blank as in claim 4 wherein:

said generally rectangular sheet comprises a separate first portion and a separate second portion;

each of said separate first and second portions having an edge portion;

said edge portions being in a face to face relationship and being located opposite to said linearly extending weakened portion; and at least said paper portions of said edge portions being secured together to preserve the integrity of said inner layer but to permit separation of said first and second portions simultaneously with the separation of said unitary sheet.

6. A carton blank as in claim 1 wherein:

said generally rectangular sheet comprises a laminate of a generally rectangular sheet of a relatively flexible paper material and a plastic material wherein said plastic material comprises a first portion and a second portion.

7. A carton blank as in claim 6 wherein:

at least portions of one of said first and second portions overlying at least portions of the other of said first and second portions;

a continuous portion of said overlying portions being secured together to preserve the integrity of said inner carton; and at least a portion of said continuous portion being located opposite to said linearly extending weakened portion to permit the separation of said first and second portions simultaneously with the separation of said.

8. A carton blank as in claim 1 and further comprising:

said at least three panel portions having at least one sidewall panel portion having opposite side edges;

a panel portion integral with each of said opposite side edges and joined to said at least one sidewall panel portion by a fold line;

said linearly extending weakened portions of said outer unitary sheet extending from a location in one of said panel portions to a location in the other of said panel portions.

9. A carton blank as in claim 1 and further comprising:

said at least three panel portions having at least one sidewall panel portion having opposite substantially parallel side edges;

said linearly extending weakened portions having at least one portion extending between said opposite side edges and having opposite ends;

said linearly extending weakened portions also having at least other portions extending from said opposite ends and forming said opposite side edges;

spout forming material having a central portion and two wing portions integral with said central portion and extending outwardly on either side thereof;

at least a portion of said central portion of said spout forming material secured to at least a portion of said central body portion of said generally rectangular sheet between said linearly extending weakened portions of said opposite side edges; and said at least a portion of said central body portion of said generally rectangular sheet being located opposite to said at least one portion of said linearly extending weakened portions so that a sufficient force can be applied to said weakened portions to separate said weakened portions and to pull said central portion and said wing portions outwardly to form a pour spout.

10. A carton blank as in claim 9 and further comprising:

a sharp point on each of said wing portions so that when said central portion is pulled outwardly said sharp points will penetrate and form openings in said generally rectangular sheet so that said portion of said generally rectangular sheet will tear along with said outer layer.

11. A carton formed from a carton blank comprising: a unitary sheet of a relatively rigid material; said unitary sheet of a relatively rigid material having a plurality of cut and fold lines for dividing said unitary sheet of a relatively rigid material into conventional panel portions having at least a central body portion having at least three panel portions joined by two fold lines; a generally rectangular sheet of a relatively flexible fluid impervious material having at least a central body portion; at least portions of said at least a central body portion of said rectangular sheet being secured to said at least a central body portion of said unitary sheet; continuous linearly extending weakened portions formed in said at least three panel portions of said unitary sheet; at least a portion of said generally rectangular sheet being weakened along a line opposite to said continuous linearly extending weakened portions; a continuous coating of adhesive securing together the portions of said at least a central body portion of said unitary sheet and said at least a central body portion of said generally rectangular sheet along and adjacent to said weakened portions; and said continuous coating of adhesive cooperating with said at least a portion of said generally rectangular sheet to preserve the integrity of said general rectangular sheet but to permit the simultaneously separation thereof with said unitary sheet comprising:

an outer layer formed from said unitary sheet of a relatively rigid material;

an inner layer formed from said generally rectangular sheet of a relatively flexible fluid impervious material;

said inner layer having a central body portion with at least portions of said central body portion secured to opposite portions of said outer layer; and at least a portion of said secured together portions having said weakened portions in a superposed relationship so that one opening can be formed simultaneously in said outer and inner layers by the application of a force to said outer layer.

12. A carton as in claim 11 wherein:

said inner layer is formed from a plastic material.

13. A carton as in claim 11 wherein said weakened portion of said inner layer comprises:

a separate first portion and a separate second portion;

at least portions of one of said first and second portions overlying at least portions of the other of said first and second portions;

a continuous portion of said overlying portions being secured together to preserve the integrity of said inner carton;

at least a portion of said continuous portions being located opposite to said linearly extending weakened portions of said outer layer to permit said simultaneously opening of said outer and inner layers.

14. A carton as in claim 11 wherein:

said inner layer comprises a laminate of a paper material and a plastic material with said paper material having said central body portion and said central body portion of said paper material being secured to opposite portions of said outer layer.

15. A carton as in claim 14 wherein said weakened portion of said inner layer comprises:

a separate first portion and a separate second portion;

each of said separate first and second portions having an edge portion;

said edge portions being in a face to face relationship and being located opposite to said linearly extending weakened portions; and at least portions of said edge portions being secured together to preserve the integrity of said inner carton but to permit separation of said first and second portions so that one opening can be formed simultaneously in said outer and inner layers.

16. A carton as in claim 11 wherein:

said inner layer comprises a laminate of a generally rectangular sheet of a relatively flexible paper material and a plastic material wherein said plastic material comprises a separate first portion and a separate second portion;

at least portions of one of said first and second portions overlying at least portions of the other of said first and second portions;

a continuous portion of said overlying portions being secured together to preserve the integrity of said inner layer; and at least a portion of said continuous portions being located opposite to said linearly extending weakened portion to permit the separation of said first and second layers so that one opening can be formed simultaneously in said outer and inner layers.

17. A carton as in claim 11 and further comprising:

said linearly extending weakened portions of said outer layer extending from a location in one of said at least three panel portions to a location in another of said at least three panel portions.

18. A carton as in claim 11 wherein said carton blank further comprises said at least three panel portions having at least one sidewall panel portion having at least a portion of said central body portion of said at least three panel portions having opposite substantially parallel side edges; said linearly extending weakened portions having at least one portion extending between said opposite side edges and having opposite ends; said linearly extending weakened portions also having at least other portions extending from said opposite ends and forming said opposite side edges and further comprising:

a spout having a central portion and two wing portions integral with said central portion and extending outwardly on either side thereof;

at least a portion of said central portion of said spout secured to at least a portion of said central body portion of said generally rectangular sheet between said linearly extending weakened portions of said opposite side edges; and said at least a portion of said generally rectangular sheet being located opposite to said at least one portion of said linearly extending weakened portions so that a sufficient force can be applied to said weakened portions to separate said weakened portions and to pull said central portion and said wing portions outwardly to form a pour spout.

19. A carton as in claim 18 and further comprising:

a sharp point on each of said wing portions so that when said central portion is pulled outwardly said sharp points will penetrate and form openings in said generally rectangular sheet so that said portion of said generally rectangular sheet will tear along with said outer layer.

* * * * *